US007699981B2

(12) United States Patent
Ledford et al.

(10) Patent No.: US 7,699,981 B2
(45) **Date of Patent: *Apr. 20, 2010**

(54) DRAIN INSTALLATION SYSTEM AND METHOD

(76) Inventors: Sam Ledford, 11801 Brookline Point, Knoxville, TN (US) 37922; Bryan Graham, 708 Fretz Rd., Knoxville, TN (US) 37922

( * ) Notice: Subject to any disclaimer, the term of this patent is extended or adjusted under 35 U.S.C. 154(b) by 36 days.

This patent is subject to a terminal disclaimer.

(21) Appl. No.: 12/055,820

(22) Filed: Mar. 26, 2008

(65) Prior Publication Data

US 2008/0168727 A1 Jul. 17, 2008

Related U.S. Application Data

(63) Continuation-in-part of application No. 11/528,850, filed on Sep. 28, 2006.

(51) Int. Cl.
*E03C 1/12* (2006.01)

(52) U.S. Cl. ..... 210/164; 210/232; 210/541; 4/679; 4/695; 4/288; 52/302.1; 52/742.14; 285/58; 411/435

(58) Field of Classification Search ..... 210/163, 210/164, 166, 232, 541, 542; 4/679, 695, 4/286, 292, 288; 52/302.1, 220.8, 742.14, 52/745.05; 285/56, 58, 390; 411/435
See application file for complete search history.

(56) References Cited

U.S. PATENT DOCUMENTS

| | | | | |
|---|---|---|---|---|
| 175,562 | A * | 4/1876 | Hovey | 285/390 |
| 1,792,345 | A * | 2/1931 | Williams | 210/164 |
| 1,956,724 | A * | 5/1934 | Lueck | 285/390 |
| 2,968,206 | A * | 1/1961 | Omoto | 411/435 |
| 3,246,582 | A * | 4/1966 | Wade et al. | 210/164 |
| 4,185,334 | A * | 1/1980 | Izzi | 285/58 |
| 4,694,513 | A | 9/1987 | Kiziah | |
| 4,883,590 | A | 11/1989 | Papp | |
| 4,984,309 | A * | 1/1991 | Lowry | 4/288 |
| 6,026,521 | A * | 2/2000 | Atkins | 285/15 |
| 6,155,015 | A * | 12/2000 | Kirby | 52/302.1 |
| 6,378,269 | B1 | 4/2002 | Wiegand, Sr. | |
| 6,381,775 | B1 * | 5/2002 | Sondrup | 210/163 |
| 6,755,966 | B1 * | 6/2004 | Reed | 210/164 |
| 2003/0159384 | A1 * | 8/2003 | Warnecke | 52/302.1 |
| 2005/0055916 | A1 * | 3/2005 | Daigger et al. | 52/302.1 |

* cited by examiner

*Primary Examiner*—Christopher Upton
(74) *Attorney, Agent, or Firm*—Luedeka, Neely & Graham, PC

(57) ABSTRACT

An apparatus and method for installing an adjustable height drain onto a conduit in a layer of hardenable material. The drain includes a grate member adjustably connected to and in fluid communication with a base member. A connection member connects the grate member and base member and is adjustable to allow the elevation of the grate member to be adjusted in relation to the base member. A spacer is disposed substantially adjacent at least a portion of the connection member to limit hardenable material from setting around the connection member when a layer of hardenable material is poured.

18 Claims, 15 Drawing Sheets

DRAIN INSTALLATION SYSTEM AND METHOD

CROSS REFERENCE To RELATED APPLICATIONS

This application is a continuation-in-part of pending U.S. patent application Ser. No. 11/528,850, filed Sep. 28, 2006.

FIELD

This invention relates to the field of systems for improving the installability of floor drains, especially drains used for concrete floors finished with a tile or the like on the surface of the concrete.

BACKGROUND

Floor drains are typically installed by plumbers on the ends of drain pipes at a certain level above grade prior to pouring a concrete slab. After a drain has been installed at the desired level, a concrete slab is poured. After the concrete slab has set, tile or other flooring is laid on top of the concrete base.

It is desirable to have the entire floor, including the grate of the drain, at a substantially uniform level. However, after the concrete sets, the grate member is fixed in position and cannot be easily adjusted to correct any differences with the level of the flooring. It is often necessary to chip away the concrete from around the grate to allow the height of the grate to be adjusted. Therefore, it is an object of this invention to allow the floor drain to remain adjustable after the concrete has set so that the level of the upper surface of the grate may be adjusted to be coextensive with the level of the flooring.

Previous attempts to remedy this problem have been made by placing plugs on top of the floor drain base when the concrete is poured. However, the drain is inoperable when these plugs are in place. As is well known, construction can often last for months or even years with long periods of inactivity possible on a job site. In floor construction, it is not uncommon for a concrete slab to be poured and then flooring to be laid several months later. Thus, it is an objective of the present invention to provide an operable height adjustable floor drain throughout construction of a floor in order to drain water and other liquids that collect.

Also, a concrete base is often ground by large grinding machines or otherwise finished prior to laying a floor. It is necessary for such finishing machines to be able to access all portions of the floor. Accordingly, it is an object of the present invention to provide a height adjustable drain which does not have portions protruding above the surface of the concrete base.

SUMMARY

The above and other needs are met by an apparatus and method for installing an adjustable height drain onto a conduit in a layer of hardenable material. The drain includes a grate member in fluid communication with a base member. In some embodiments, the grate member is adjustably connected to the base member and in other embodiments is adjustably connected to an adapter adjacent the base member. A spacer is disposed substantially adjacent at least a portion of the grate member to limit hardenable material from setting around the grate member when a layer of hardenable material is poured.

The spacer may be a loop of compressible material which is compressible generally between the grate of the grate member and the base member. The compressible material creates a void in the area around the grate member and prevents hardenable material from setting around the grate member.

The grate member may include a grate portion substantially nested in a removable concentric disc. As the grate member is elevationally adjusted towards the base member, the removable disc is biased towards the base member, thereby compressing the compressible material against the base member.

The spacer may also be the removable disc itself. The disc may be of a sufficient height that it prevents the hardenable material from setting adjacent the grate member.

After a layer of hardenable material is poured, flooring material may be installed on the upper surface of the hardenable material. The spacer may be removed from adjacent the grate member. The grate member may then be elevationally adjusted so that its upper surface is substantially flush with the upper surface of the flooring material. A second hardenable material can be placed into the void around the grate member formed by the sealing mechanism to create a base for flooring to be laid against the grate to create a coextensive floor.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
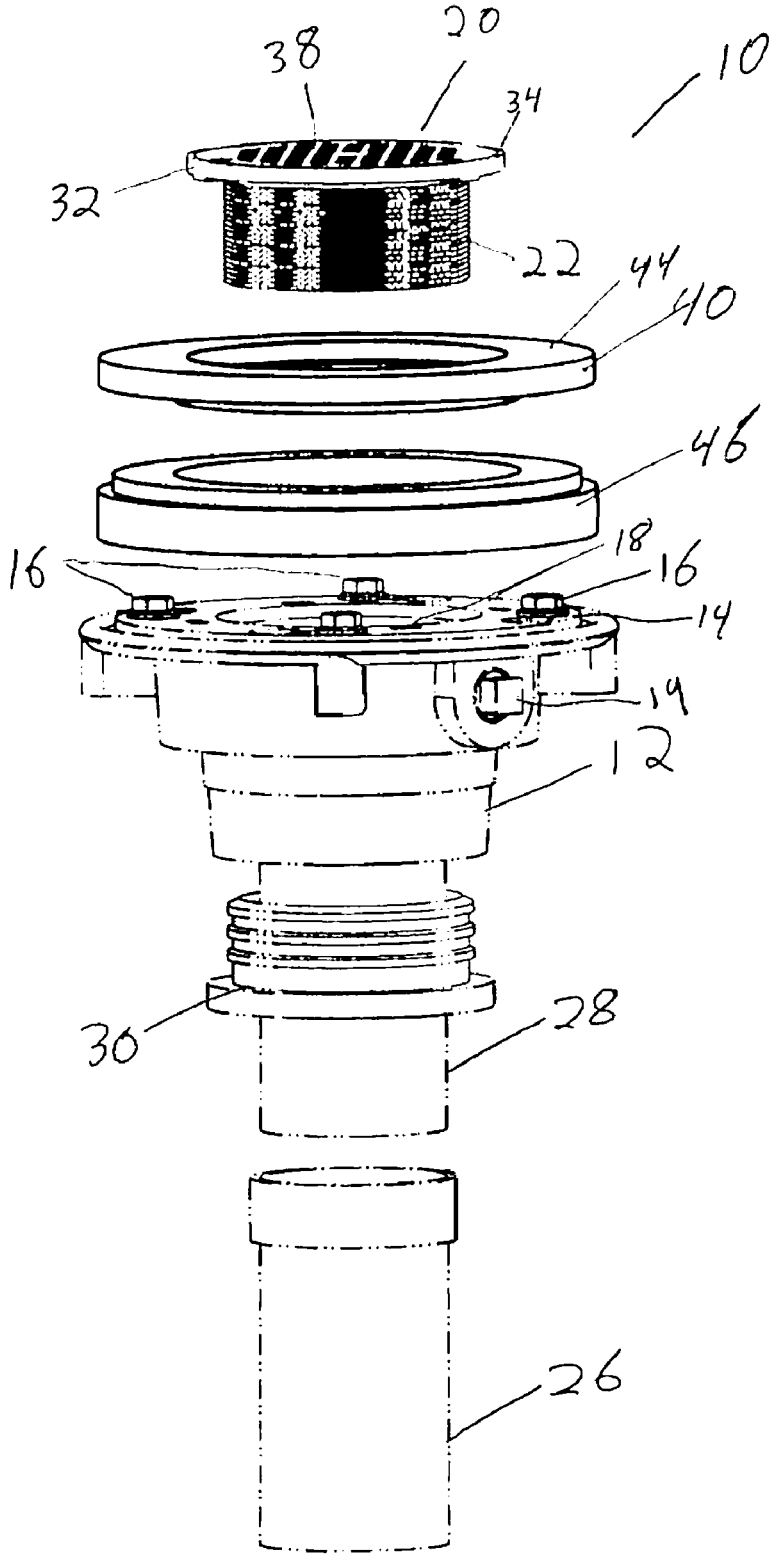
FIG. 1 is an exploded view of a floor drain apparatus according to a preferred embodiment of the invention.
Figure 2:
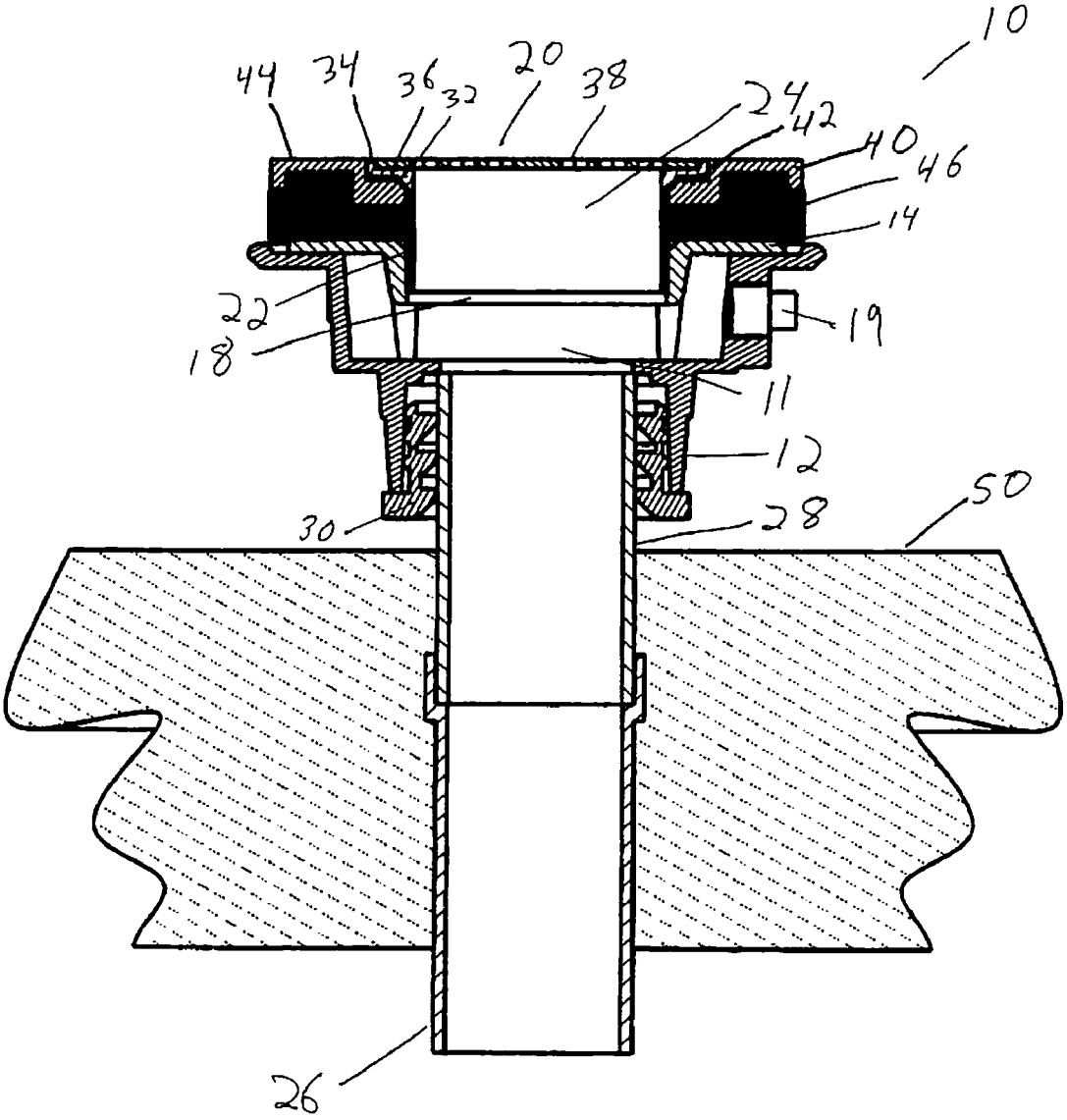
FIG. 2 is a cutaway view of a floor drain apparatus according to a preferred embodiment of the invention.
Figure 3:
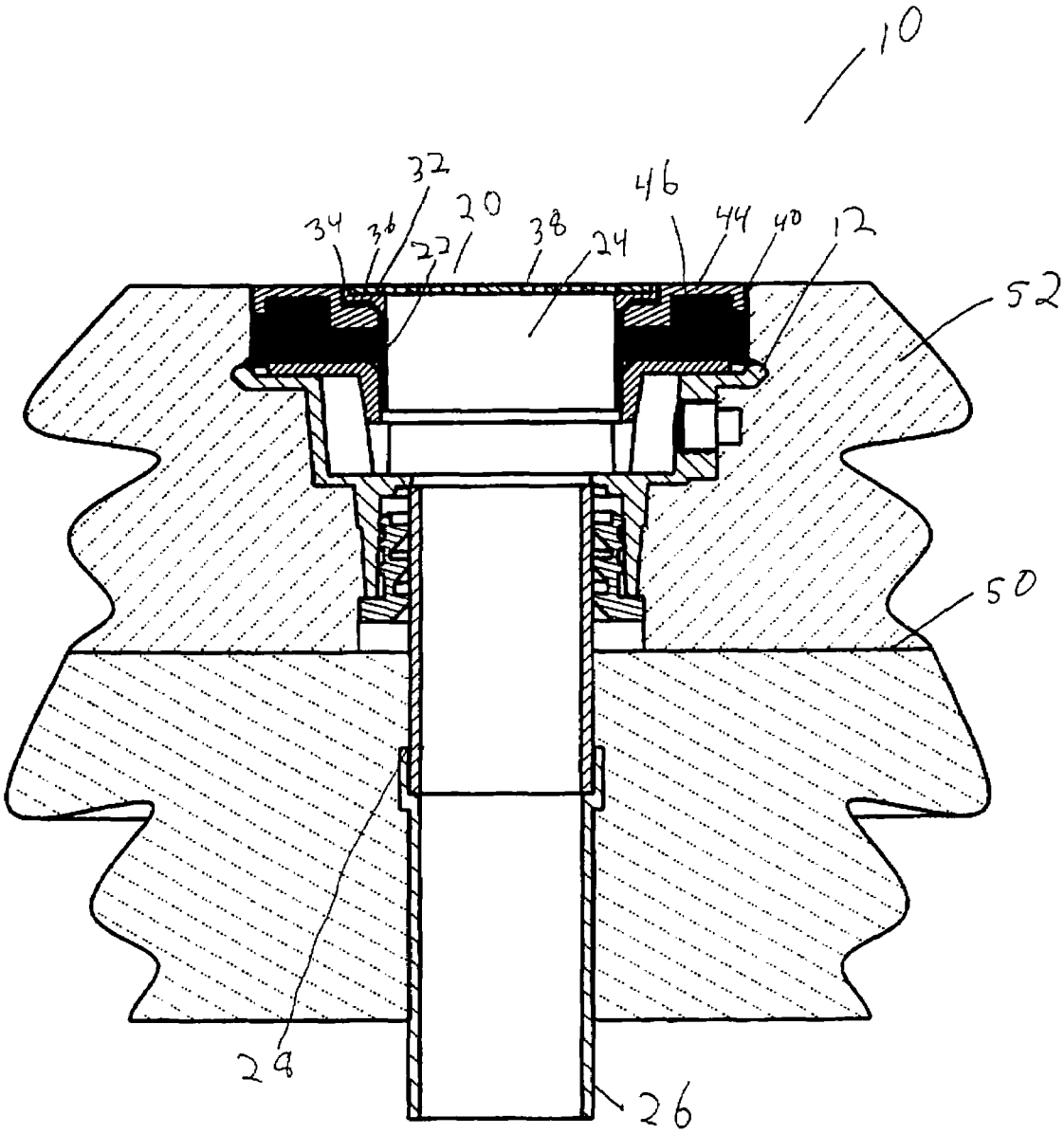
FIG. 3 is a cutaway view of a preferred embodiment of a floor drain apparatus wherein a concrete floor base has been poured to the level of the upper surface of the grate and extension ring.
Figure 4:
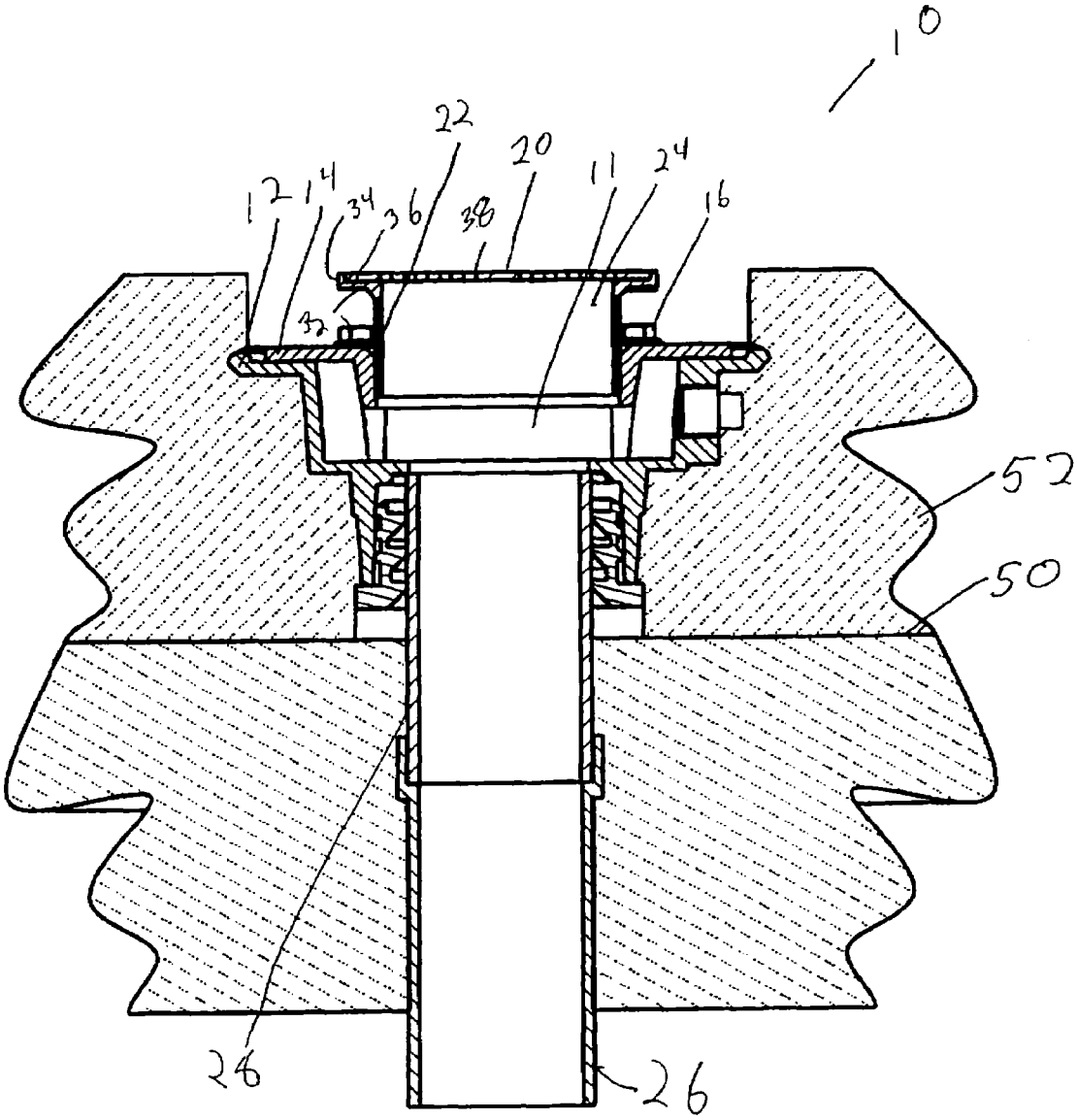
FIG. 4 is a cutaway view of a preferred embodiment of a floor drain apparatus installed in a concrete floor base wherein the extension ring and sealing ring have been removed.
Figure 5:
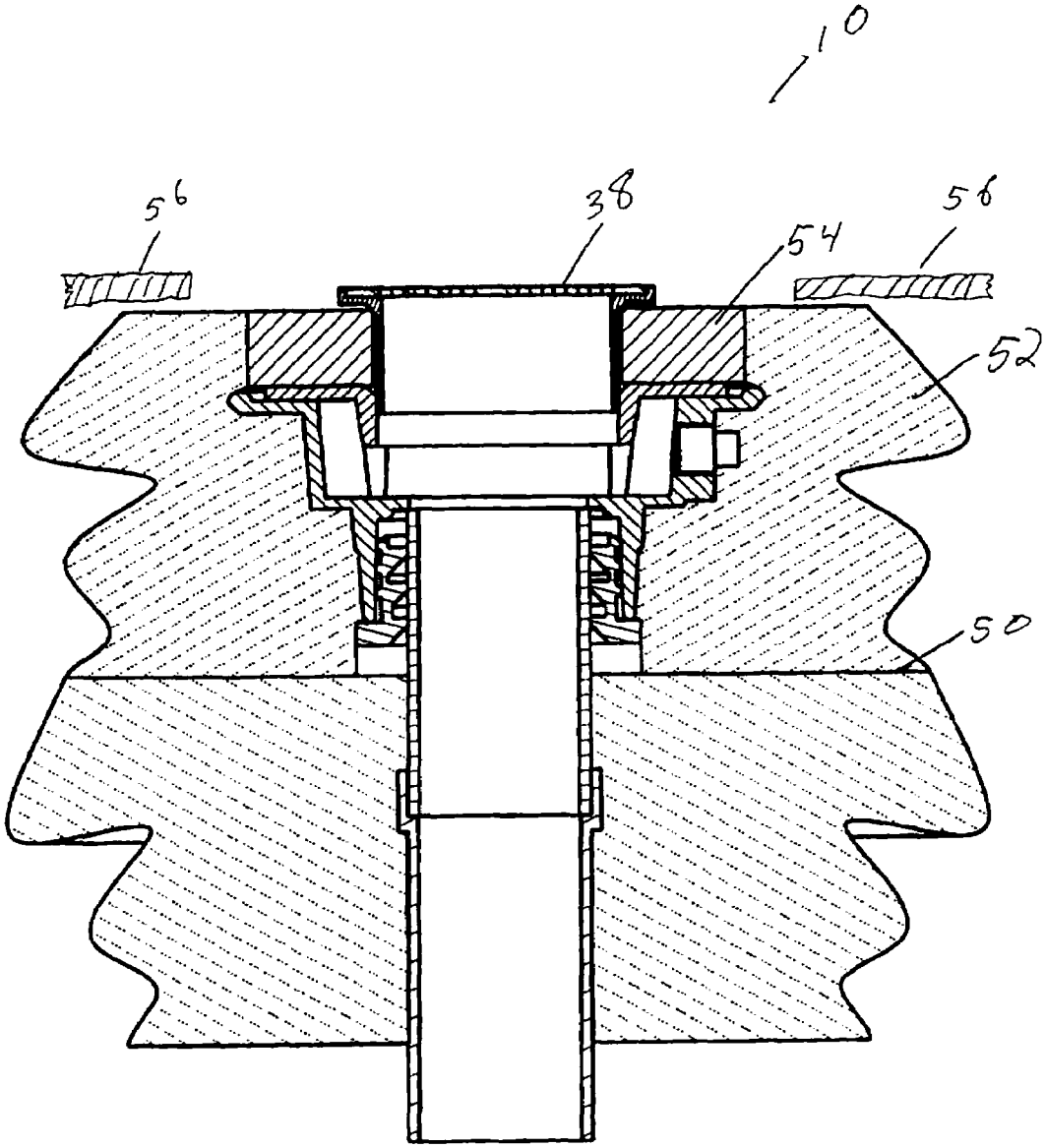
FIG. 5 is a cutaway view of a preferred embodiment of a floor drain apparatus installed in a concrete floor base where tile has been laid on areas of the floor, the height of the grate member has been adjusted so that the upper surface of the grate will be the same level as the upper surface of the tile, and a filler material has been placed into the recess in the concrete created by the extension ring and sealing ring.
Figure 6:
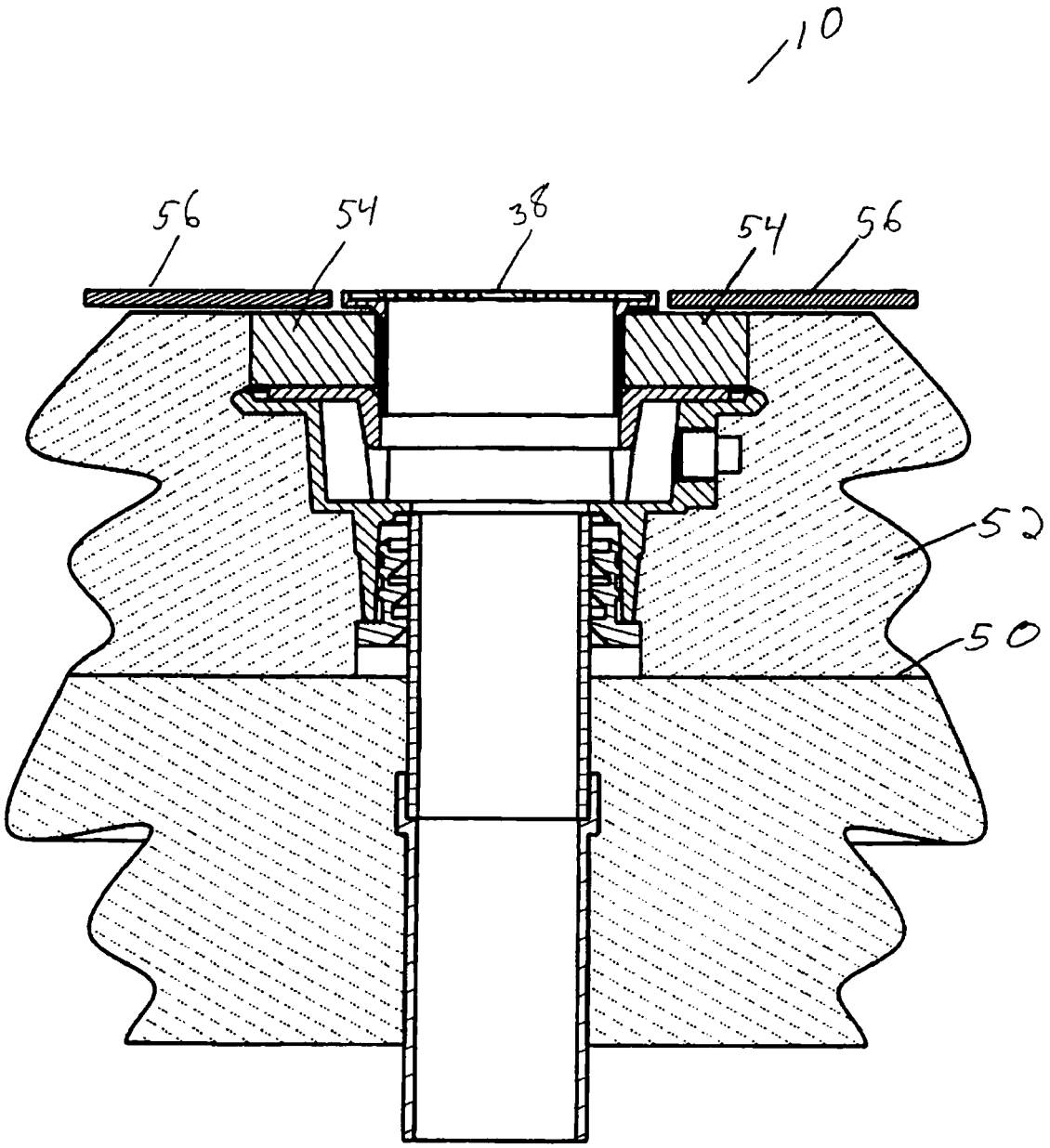
FIG. 6 is a cutaway view of a preferred embodiment of a floor drain apparatus installed in a concrete floor base wherein flooring has been installed up to the perimeter of the grate.
Figure 7:
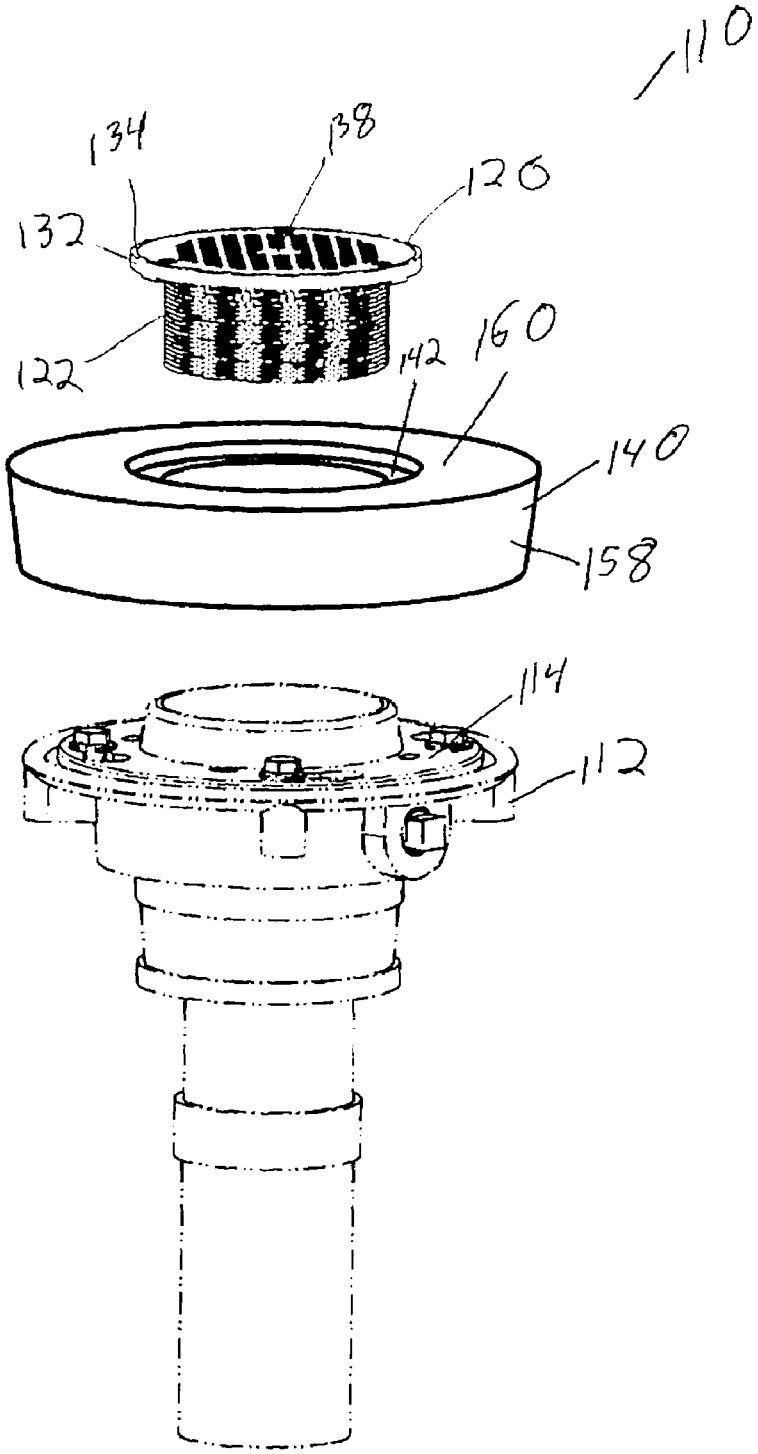
FIG. 7 is an exploded view of a floor drain apparatus according to an alternate embodiment of the invention.
Figure 8:
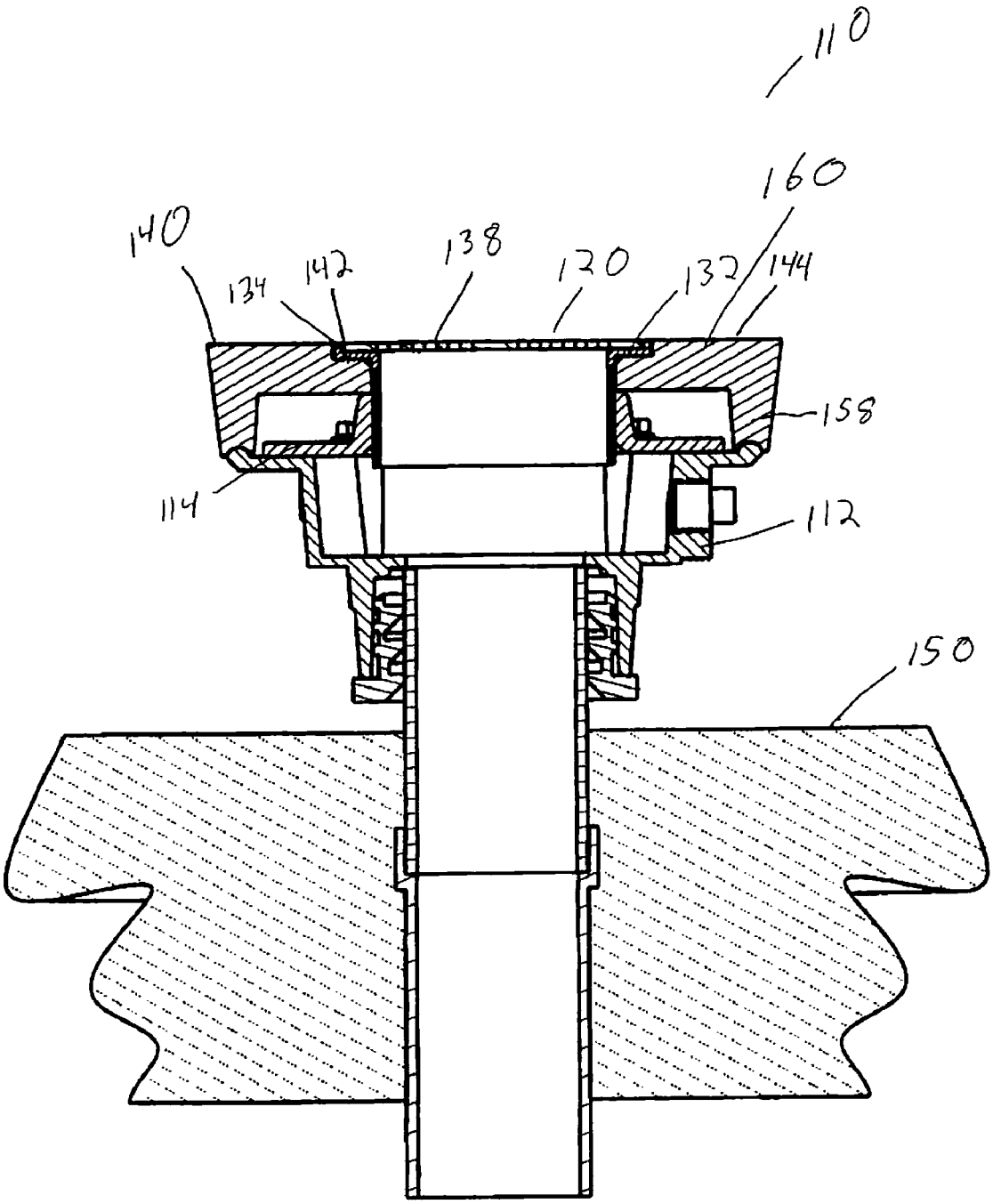
FIG. 8 is a cutaway view of a floor drain apparatus according to an alternate embodiment of the invention.
Figure 9:
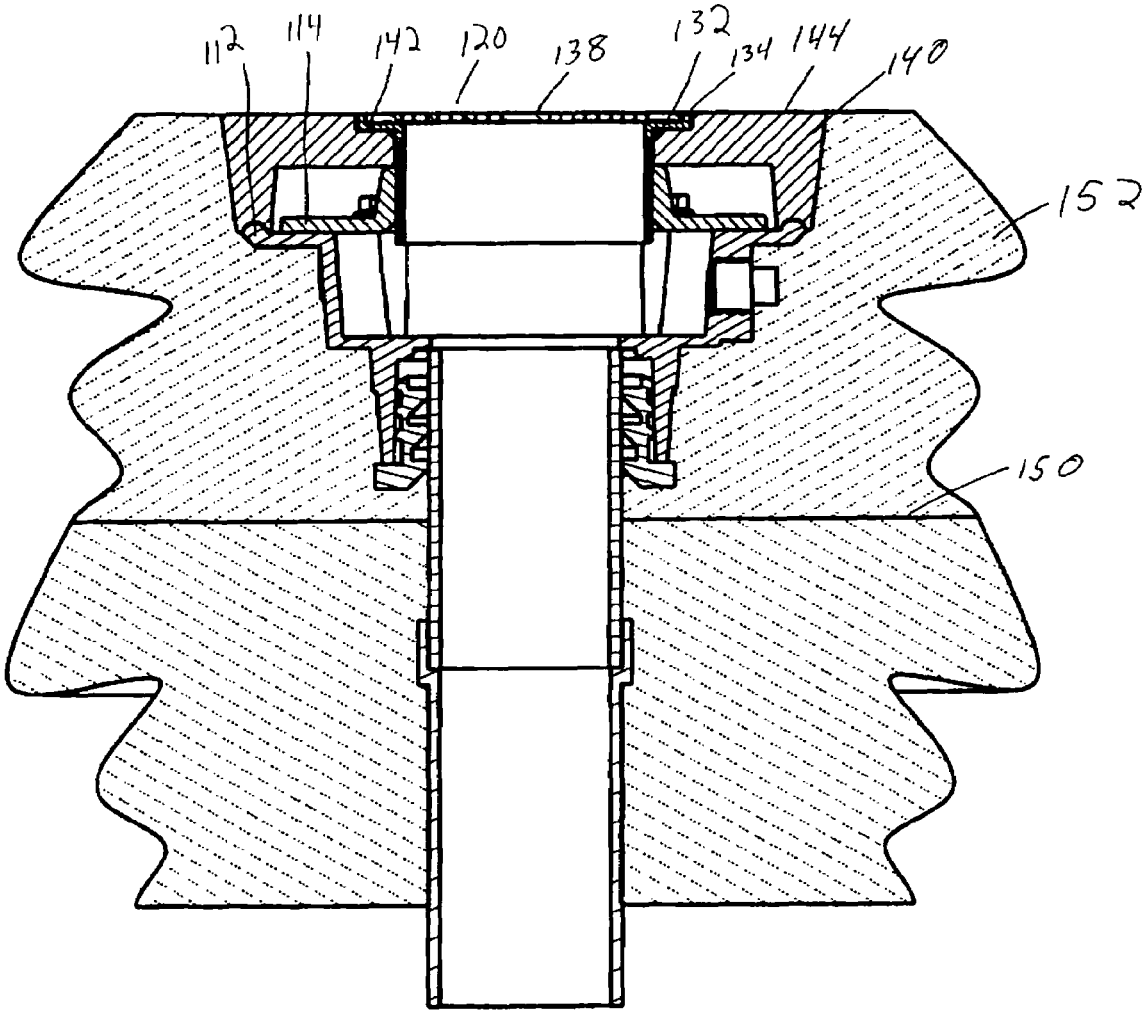
FIG. 9 is a cutaway view of an alternate embodiment of a floor drain apparatus wherein a concrete floor base has been poured to the level of the upper surface of the grate and extension ring.
Figure 10:
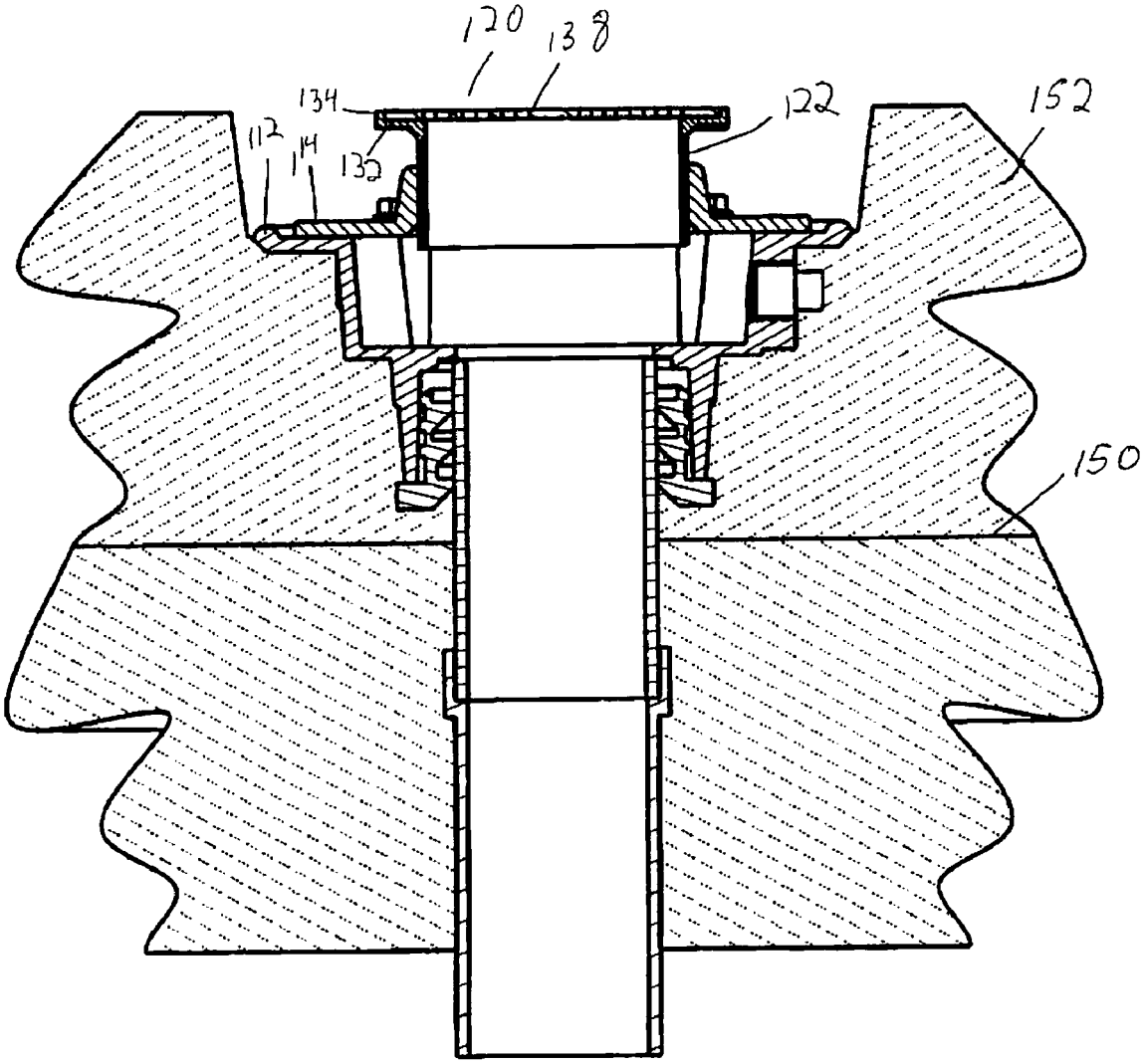
FIG. 10 is a cutaway view of an alternate embodiment of a floor drain apparatus installed in a concrete floor base wherein the extension ring has been removed.
Figure 11:
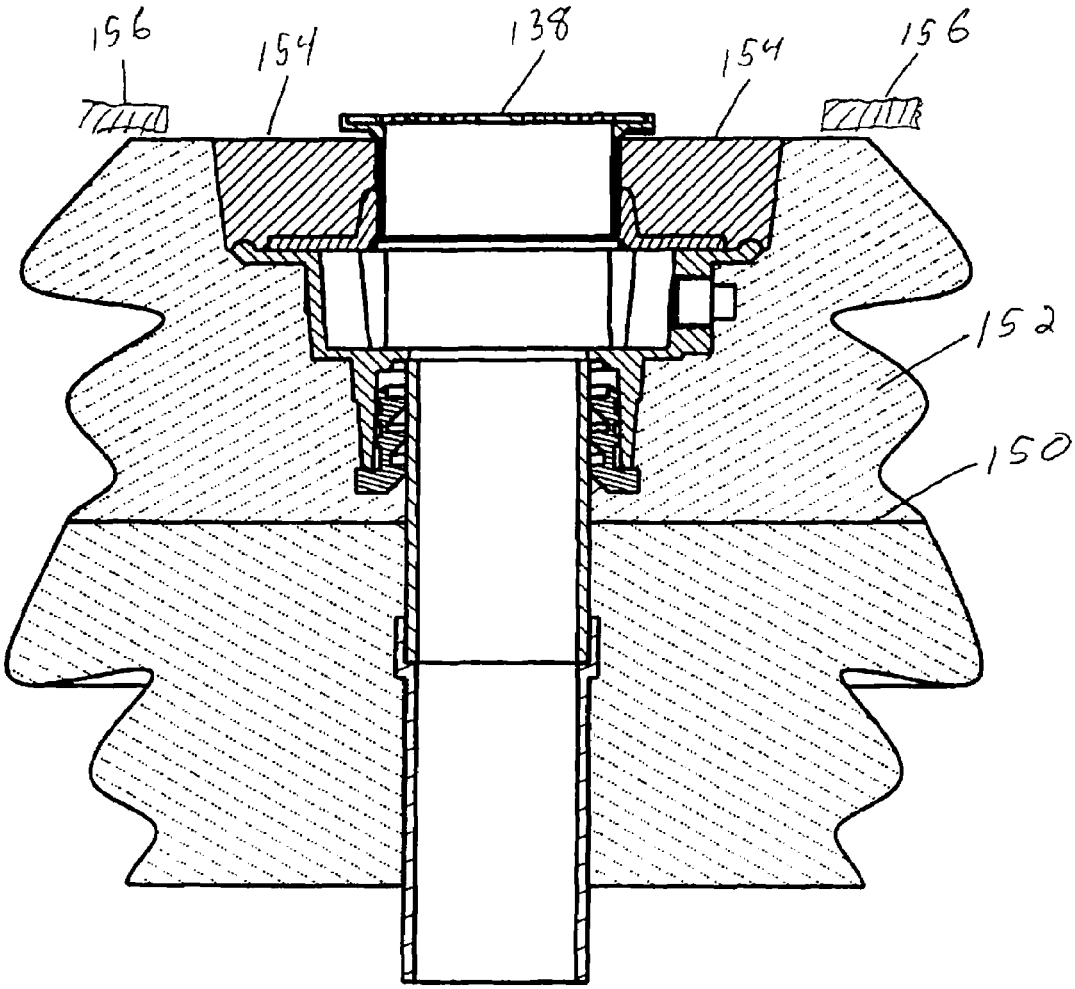
FIG. 11 is a cutaway view of an alternate embodiment of a floor drain apparatus installed in a concrete floor base where tile has been laid on areas of the floor, the height of the grate member has been adjusted so that the upper surface of the grate will be the same level as the upper surface of the tile, and a filler material has been placed into the recess in the concrete created by the extension ring.
Figure 12:
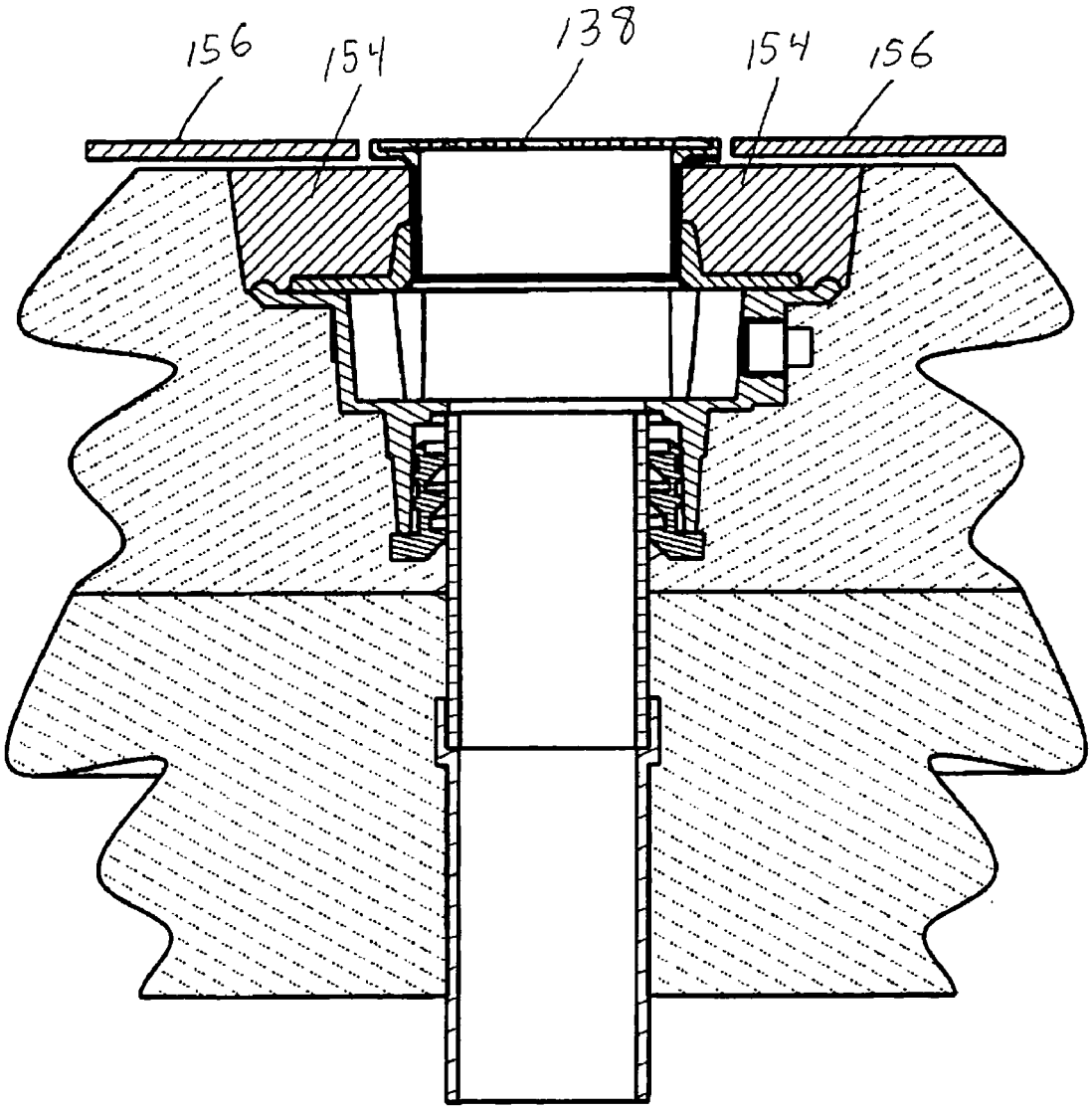
FIG. 12 is a cutaway view of an alternate embodiment of a floor drain apparatus installed in a concrete floor base wherein flooring has been installed up to the perimeter of the grate.

A preferred embodiment of the floor drain system 10 of the present invention is shown in FIGS. 1 & 2. The system includes a drain base 12 with a central, substantially circular through opening 11 oriented on a vertical axis. The base member 12 perferably comprises an integral disc-shaped, horizontally disposed surrounding base flange 14 which forms the top part of the base member 12 and extends outwardly from generally around the central opening 11 in the base 12. The base flange 14 is removably connected to the upper portion of the base 12 using bolts 16 or other suitable means thereby allowing access to the interior of the base for maintenance of otherwise. A substantially cylindrical base flange opening 18 is internally threaded to receive a depending cylindrical, externally threaded connector 22 integrally formed as part of an upstanding grate member 20. The cylindrical connector 22 of the grate member 20 has a central circular opening 24 extending vertically through its length in flow communication and in vertical alignment with the opening 11 in the base member 12 when the two are threadably interconnected.

The bottom portion of the base is connectible to any of the standard conduits for draining liquid away from the area, typically disposed beneath the floor within or below concrete. For example, as shown in FIGS. 1 & 2, a PVC drain pipe 26 may be connected to the base by a pipe coupling 28, where the pipe coupling 28 has an externally threaded end portion 30 which is threadably connected to the bottom of the base 12. The drain pipe 26 and pipe coupling 28 have substantially cylindrical openings extending vertically through at least a portion of their lengths in flow communication and vertical alignment with the opening 11 in the base member 12.

Also, a water inlet 19 may be disposed in the base 12 which admits a steady, slow stream of water into the floor drain system 10 to keep a trap (not shown) primed in order to prevent sewer gas from entering the floor drain.

The grate member 20 further preferably includes an upper, integrally formed outwardly projecting disc-shaped grate flange 32 disposed in substantially parallel, vertically spaced-apart relation to the base flange 14. The upper surface of the grate flange has a narrow, upstanding circular rim 34 around its perimeter. A recessed circular grate shelf 36 just inside the rim 34 is concentrically arranged vis-à-vis the rim 34 and the grate opening 24, and is dimensioned to fittingly receive a circular grate thereon 38. The grate 38 is removably attached to the shelf by spaced-apart screws or other suitable connection devices so the top surface of the grate 38 is flush with the top surface of the surrounding rim 34.

The rim area of the grate flange 32 fits onto a narrow interior, circular ledge 42 of an extension ring 40, the outer edge of which is generally vertically aligned with the outer edge of the base flange 14. The upper and lower surfaces of the extension ring 40 are relatively wide and flat, and the ring is preferably dimensioned so that its upper surface 44 is substantially flush with the upper surfaces of the rim 34 and the grate 38. In alternate embodiments, the external ring 40 may be integral with the grate flange 32.

A resiliently compressible substantially donut-shaped seal ring 46 made of a material such as Armiflex is dimensioned to fit between the base flange 14 and the extension ring 40 around the threaded, cylindrical connector 22 of the grate member 20. The seal ring 46 may be a continuous loop. Alternately, the seal ring 46 may be a discontinuous loop or even comprise two or more separate portions so that the seal rings may be disposed around the connector 22 after the grate member 20 has been connected to the base 12.

As the grate member 20 is advanced deeper into the base 12 via the threaded interconnection of the two parts, the seal ring 46 becomes resiliently compressed between the upper surface of the base flange and the lower surfaces of the grate flange and extension ring. In alternate embodiments, no extension ring 40 is used and the seal ring 46 may be compressed between the grate flange 32 and the base flange 14.

The base, grate member, and extension ring are preferably a made from a suitable metallic material, such as cast iron or stainless steel, but may also be made of any other suitable material such as plastic.

In use of the system of the preferred embodiment, as shown in FIGS. 2-6, the components of the drain system 10 are assembled with the grate flange 32 resting on the ledge 42 of extension ring 40 and the seal ring 46 disposed between the base flange 14 and the extension ring 40. The grate member 20 is then threaded down into the base member 12 until the top surface of the grate member 20 is at a height in the base 12 above grade 50 substantially corresponding to the expected height to which a concrete layer 52 will be poured. This downward movement of the grate member 20 and its flange portion 32 carries the extension ring 40 downwardly along with it, thereby compressing the seal ring 46 against the base flange 14 as described above. Concrete 52 is then poured so that its top surface is substantially flush with the top surface 44 of the extension ring 40. The seal ring 46 in compression and the extension ring 40 above it serve to prevent concrete 52 from setting around the grate member 20, thereby allowing the threaded connector 22 of the grate member 20 and the base member 12 to remain adjustable. Also, the drain 10 is operable before, during, and after the concrete has been laid.

After concrete 52 has been poured and sufficiently set such that it no longer exhibits substantial liquid characteristics, the grate member 20, extension ring 40, and seal ring 46 can be removed. Thereafter, a tile 56 or other floor may be laid on top of the surface of the concrete. Once the tile floor has been partially laid, the grate member 20 can be threaded back into the base 12 a distance and adjusted to a height substantially level with the grade of the tile. Caulking, grout, or other material 54 may then be placed in the void left by the seal ring and extension ring up to the level of the concrete 52. Tile 56 may then be laid up to the edge of the rim 34 of the grate member 20 to finish the tile flooring. In the alternative, the extension ring 40 can be left in place and the tile 56 finished up to its edge. The drain grate 38 will then be flush or level with the surface of the tile floor.

Another preferred embodiment of the apparatus and method of the drain system of the present invention is shown in FIGS. 7-12, wherein a seal ring 46 is not used. The base 112 and grate member 120 and their components are of corresponding structure to the base 12 and grate member and their components in the embodiment described above. However, rather than using the compressible seal ring, extension rings 140 of various heights may be used.

The rim area of the grate flange 132 fits onto a narrow interior, circular ledge 142 of an extension ring 140, the outer edge of which is generally vertically aligned with the outer edge of the base 112 or base flange 114 in various embodiments. The upper surface 144 of the extension ring 140 is relatively wide and flat, and the ring is preferably dimensioned so that its upper surface 144 is substantially flush with the upper surfaces of the rim 134 and the grate 138. The extension ring 140 has sidewalls 158 extending down from an upper disc-like portion 160. The sidewalls generally rest on the top of the base 112.

In use of the drain system 110, as shown in FIGS. 8-12, an extension ring 140 is chosen with sidewalls of a sufficient height so that when the components of the drain system 110 are assembled with the grate flange 132 resting on the ledge 142 of extension ring 140 and the grate member 20 is threaded down into the base member 112, the top surface of the grate member 120 and the extension ring 140 are at a height in the base 112 above grade 150 substantially corresponding to a desired height to which a concrete layer 152 will be poured. A drain installer may be provided with a kit having extension rings of various heights to allow for a wide variation in heights to which the grate may be set prior to pouring the concrete layer.

After the grate member 120 is threaded into the base member 112, concrete 152 is then poured so that its top surface is substantially flush with the top surface 144 of the extension ring 140. The extension ring 140 serves to prevent concrete 152 from setting around the grate member 120, thereby allowing the threaded connector 122 of the grate member 120 and the base member 112 to remain adjustable. Also, the drain 110 is operable before, during, and after the concrete has been laid.

After concrete 152 has been poured and sufficiently set such that it no longer exhibits substantial liquid characteristics, the grate member 120 and extension ring 140 can be removed. Thereafter, a tile 156 or other floor may be laid on top of the surface of the concrete. Once the tile floor has been partially laid, the grate member 120 can be threaded back into the base 112 a distance and adjusted to a height substantially level with the grade of the tile. Caulking, grout, or other material 154 may then be placed in the void left by the seal ring and extension ring up to the level of the concrete 52. Tile 156 may then be laid up to the edge of the rim 134 of the grate member 120 to complete the tile floor. In the alternative, if desired, the extension ring 140 can be left in place and the tile 156 finished up to its edge. The drain grate 138 will be then flush or level with the surface of the tile floor.

Figure 13A:
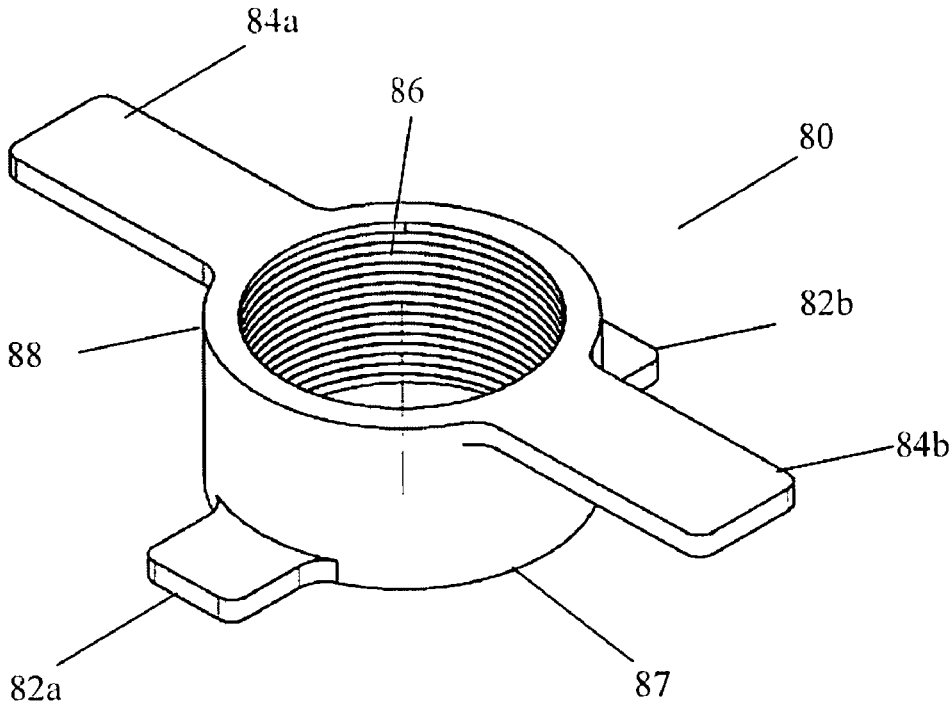
FIG. 13*a* is a perspective view of an adapter for connecting the grate member of the floor drain apparatus to a drain base according to an embodiment of the invention.
Figure 13B:
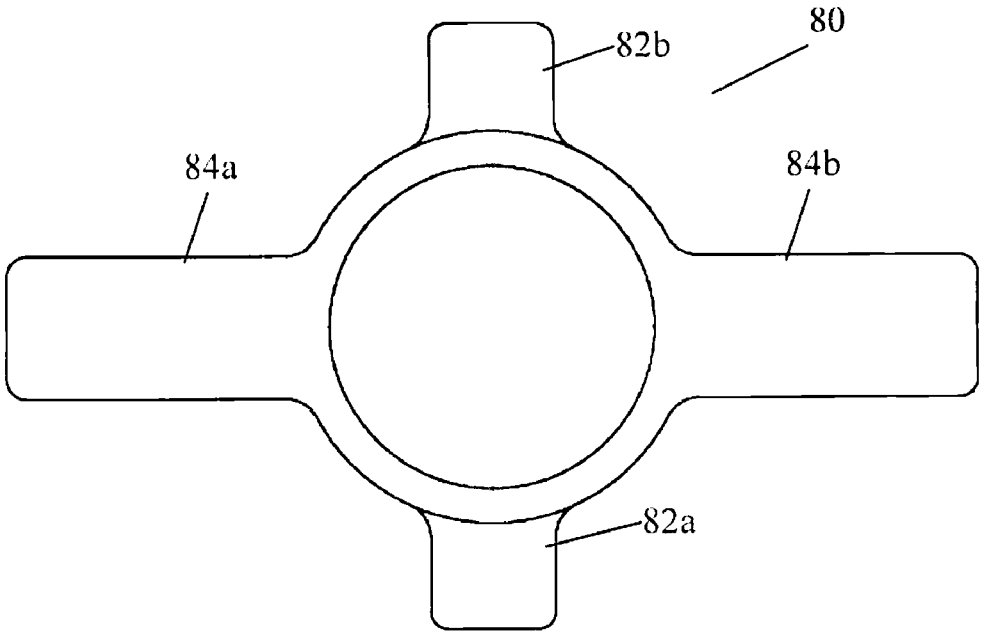
FIG. 13*b* is a top view of the adapter for connecting the grate member of the floor drain apparatus to a drain base.
Figure 14:
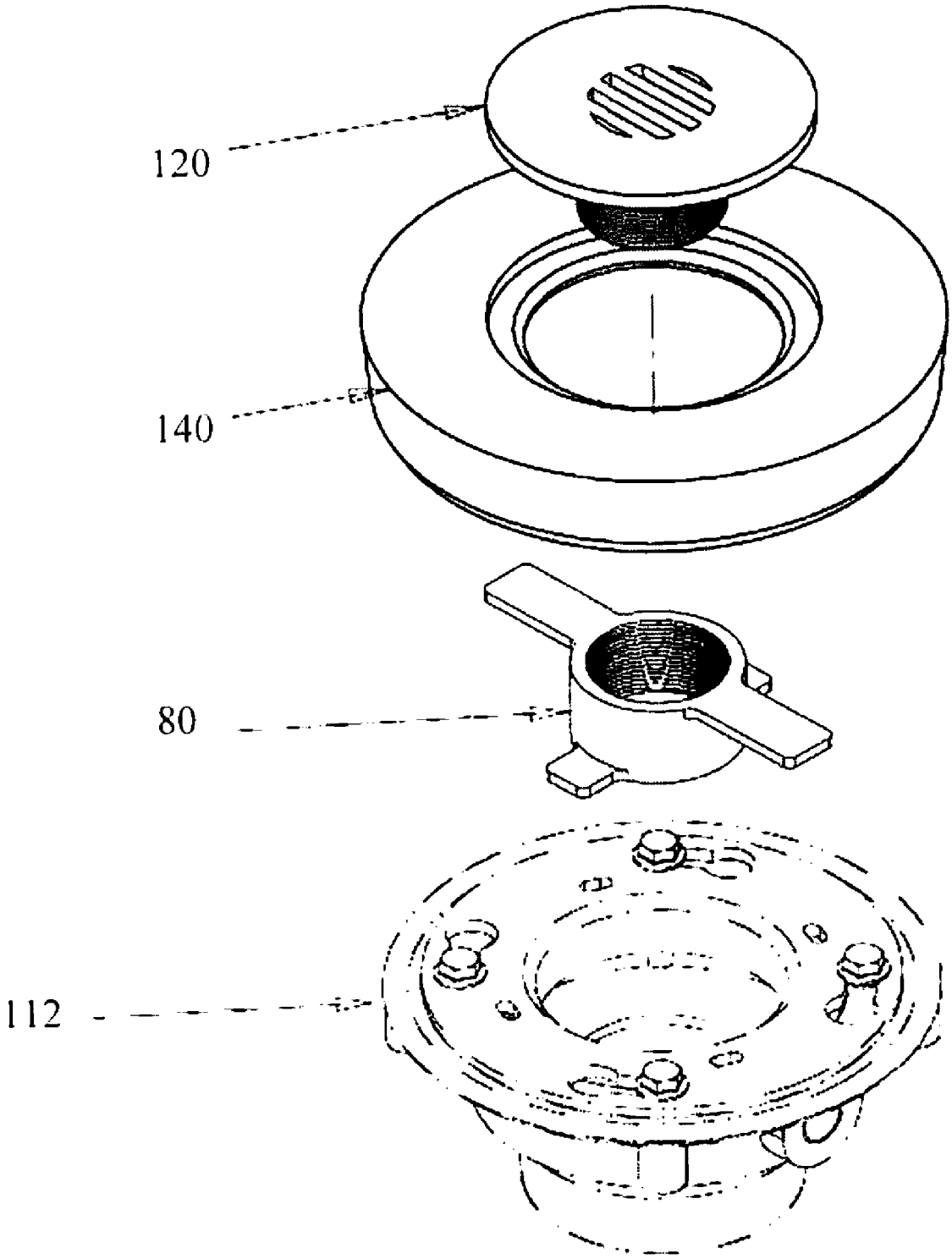
FIG. 14 is an exploded view of the floor drain apparatus including an adapter for connecting the grate member to a drain base according to an embodiment of the invention.

In a further embodiment of the invention, an adapter may be used for connecting the threaded connector 22/122 to the drain base 12/112, in order to allow the system to be used with drain bases of various sizes having cylindrical base flange openings 18 of various diameters. As shown in FIGS. 13*a* and 13*b*, the adapter may be a tabbed collar 80 with a threaded cylindrical opening 86 extending therethrough for receiving the threaded connector 22/122 therein. A first set of tabs 82*a* and 82*b* extend outwardly from the circumference of the collar 80 substantially adjacent the bottom edge 87 of the collar. The first set of tabs 82*a* and 82*b* are preferably spaced apart from each other about the circumference approximately 180 degrees. A second set of tabs 84*a* and 84*b* extend outwardly from the circumference of the collar 80 substantially adjacent the top edge 88 of the collar. The second set of tabs 84*a* and 84*b* are preferably spaced apart from each other about the circumference approximately 180 degrees and are preferably spaced apart from the first set of tabs approximately 90 degrees.

Figure 15A:
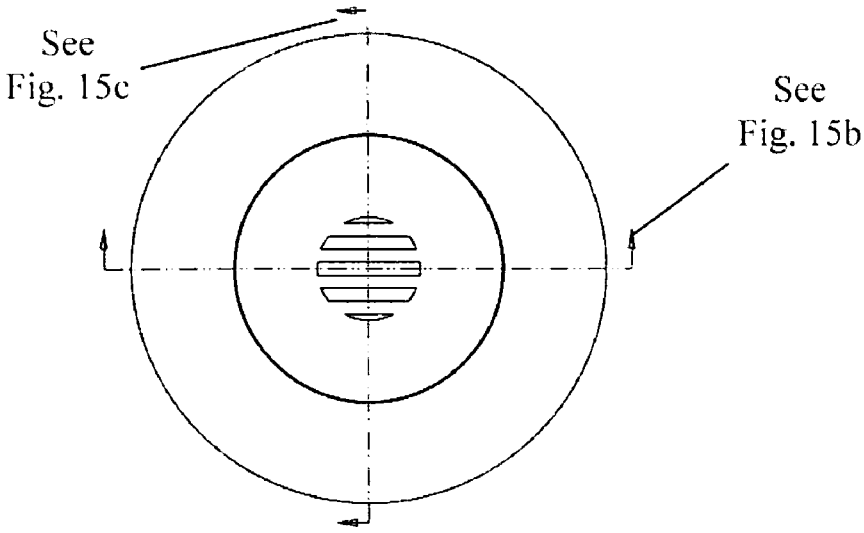
FIG. 15*a* is a top view of the floor drain apparatus including an adapter for connecting the grate member to a drain base.
Figure 15B:
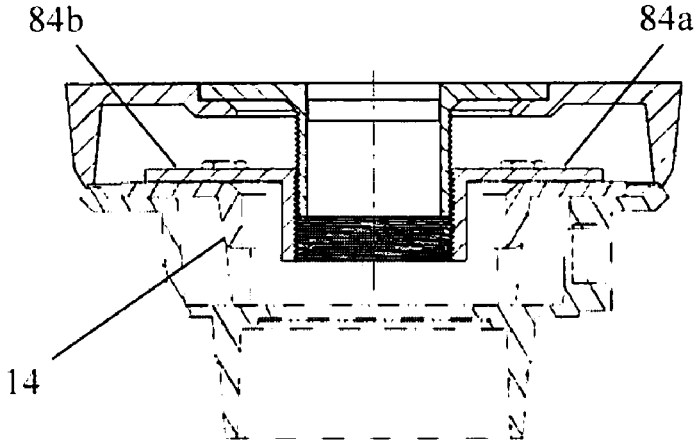
FIGS. 15*b* & 15*c* are cutaway views of the floor drain apparatus including an adapter for connecting the grate member to a drain base.
Figure 15C:
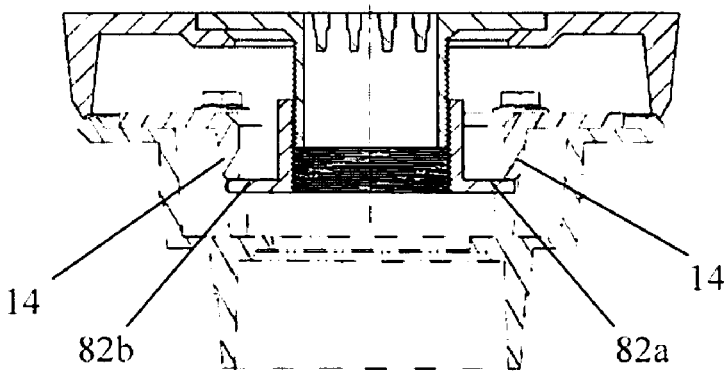

The first set of tabs 82*a* and 82*b* are sized such that the bottom portion of the threaded collar may be slid into cylindrical flange openings 18 of various sizes. IAs shown in FIGS. 15*b* and 15*c*, after being slid into a cylindrical flange opening, the first set of tabs 82*a* and 82*b* abut the base flange 14/114 when the tabbed collar is substantially centered within the cylindrical flange opening, thereby limiting the ability to remove the tabbed collar from the opening and holding the floor drain apparatus in place in the drain base during use. When placed in the cylindrical flange opening, the second set of tabs 84*a* and 84*b* preferably rest on the base flange to prevent the collar from falling into the drain base. In this regard, the second set of tabs 84*a* and 84*b* preferably extend farther from the circumference of the collar 80 than the first set of tabs 82*a* and 82*b* in order to limit the ability to slide through the cylindrical flange opening.

After placement of the tabbed collar 80 into the cylindrical flange opening 18, the threaded connector 22/122 may be threaded into the threaded cylindrical opening 86. Thereafter, as exemplified in FIGS. 15*b* and 15*c*, the system may be used substantially as described in the previous embodiments with the seal ring 46 or extension ring 140. The tabbed collar 80 may remain in the drain base flow through opening and the grate member may be used as the drain in the finished floor. However, in alternate embodiments, the tabbed collar 80 may be removed from the drain base after concrete has been poured to the desired level and a second grate member sized to be threadably connected directly to the base member may be used.

In alternate embodiments, various other adapters may be used to facilitate the use of the system of the present invention with drain bases of several different sizes.

The foregoing description of preferred embodiments for this invention have been presented for purposes of illustration and description. They are not intended to be exhaustive or to limit the invention to the precise form disclosed. Obvious modifications or variations are possible in light of the above teachings. For example, although the floor drain system is described with regard to preferred base members and grate members, adjustable drains with base members and grate members of various configurations typical in the plumbing field may be used with the invention. Further, the invention may be used in "non-floor" applications where a drain is at least partially enclosed in a solid material. The disclosed embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A method for installing a drain comprising the steps of:

connecting a base member having a flow-through opening therein to an opening of a drain conduit for draining fluid away from a drainage area such that the flow-through opening of the base member is in flow communication with the opening of the drain conduit;

adjustably connecting a flanged drain member having a flow-through opening therein to the base member such that the flow-through opening of the flanged drain member is in flow communication with the flow-through opening of the base member;

disposing a spacer generally between a flange on the flanged drain member and the base member;

disposing a first hardenable material adjacent the base member and spacer to a desired level; and upon sufficient hardening of the first hardenable material, substantially removing the spacer so as to define a void adjacent the flanged drain member.

2. The method of claim 1, wherein the step of adjustably connecting the flanged drain member to the base member comprises adjustably connecting the flanged drain member to an adapter disposed within the flow-through opening of the base member, wherein the adapter has a flow-through opening therein and further wherein the adapter is configured for use with base members having flow-through openings of various diameters.

3. The method of claim 2, wherein the step of adjustably connecting the flanged drain member to the base member comprises threadably connecting a depending threaded cylindrical portion of the flanged drain member to a matably threaded portion of the adapter.

4. The method of claim 2, wherein the adapter comprises a tabbed collar with a first set of tabs extending outwardly from the circumference of the collar substantially adjacent a bottom edge of the collar and a second set of tabs extending outwardly from the circumference of the collar substantially adjacent a top edge of the collar, and further wherein the distance from the outward end of a first tab to the outward end of a second tab comprising the first set of tabs and the distance from the outward end of a third tab to the outward end of a fourth tab comprising the second set of tabs are both greater than the diameter of the flow-through opening in the base member, such that the circumference of the drain base flow-through opening is substantially located between the first set of tabs and the second set of tabs to substantially maintain the disposition of the tabbed collar within the flow-through opening of the base member.

5. The method of claim 1, wherein the step of adjustably connecting the flanged drain member to the base member comprises threadably connecting a depending threaded cylindrical portion of the flanged drain member to a matably threaded portion of the base member.

6. The method of claim 1, further comprising the step of laying flooring material on an upper surface of the first hardenable material; and further wherein the desired level of a grate connected to an upper portion of the flanged drain member is substantially coextensive with an upper surface of the flooring material.

7. The method of claim 6, further comprising the step of disposing a second hardenable material in the void after the position of the flanged drain member has been adjusted such that the grate is substantially coextensive with the upper surface of the flooring material.

8. The method of claim 1, further comprising the step of adjusting the position of the flanged drain member such that the level of the flanged drain member is in a desired relationship with the desired level of the first hardenable material.

9. The method of claim 1, wherein the spacer is disposed substantially adjacent the base member before the flanged drain member is adjustably connected to the base member.

10. The method of claim 1, wherein the spacer is disposed generally between the flange of the flanged drain member and the base member after the flanged drain member is adjustably connected to the base member.

11. The method of claim 1, wherein the spacer comprises a compressible material; and further comprising the step of compressing the compressible material generally between the flange of the flanged drain member and the base member when the flanged drain member is adjustably connected to the base member.

12. A drain installation system comprising a flanged drain member and a base member which is connected to an opening of a drain conduit for draining fluid away from a drainage area, wherein the improvement comprises an adapter for connecting the flanged drain member to the base member comprising a tabbed collar for disposition within a flow-through opening in the base member, the tabbed collar comprising a first set of tabs extending outwardly from the circumference of the collar substantially adjacent a bottom edge of the collar and a second set of tabs extending outwardly from the circumference of the collar substantially adjacent a top edge of the collar, wherein the distance from the outward end of a first tab to the outward end of a second tab comprising the first set of tabs and the distance from the outward end of a third tab to the outward end of a fourth tab comprising the second set of tabs are both greater than the diameter of the flow-through opening in the base member, such that a circumference of the drain base flow-through opening is substantially located between the first set of tabs and the second set of tabs to substantially maintain the disposition of the tabbed collar within the flow-through opening of the base member, and further wherein the tabbed collar comprises a threaded through opening for adjustably, matably receiving a threaded depending cylindrical portion of the flanged drain member.

13. A drain installation system for maintaining adjustability of a drain, the drain installation system comprising:

a base member with a flow-through opening therein, wherein the base member is connectable to an opening of a drain conduit for draining fluid away from a drainage area such that the flow-through opening of the base member is in flow communication with the opening of the drain conduit;

a drain grate member having a flow-through opening therein, wherein the drain grate member is adjustably connectable to the base member such that the flow-through opening of the grate member is in flow communication with the flow-through opening of the base member, said grate member having a grate adjacent its uppermost portion for ingress of fluids into the flow-through opening thereof; and a removable spacer for disposition generally between the grate of the grate member and the base member when the grate member is adjustably connected to the base member to create a void adjacent the grate member when a hardenable material is disposed adjacent the drain installation system and the spacer is removed after the hardenable material is substantially hardened.

14. The drain installation system of claim 13, wherein the spacer comprises a continuous loop of compressible material for substantially encircling at least a portion of the grate member.

15. The drain installation system of claim 13, wherein the spacer comprises a discontinuous loop of compressible material for substantially encircling at least a portion of the grate member such that the loop of compressible material may be more easily disposed generally between the grate of the grate member and the base member after the grate member has been adjustably connected to the base member.

16. The drain installation system of claim 13, wherein the grate member comprises a threaded depending cylindrical portion for adjustably mating with a threaded portion of the base member.

17. The drain installation system of claim 13, wherein the drain installation system remains operable for draining fluid from a drainange area when the hardenable material is disposed adjacent the drain installation system.

18. The drain installation system of claim 13, wherein the drain installation system does not include any portion which extends above an upper surface of the hardenable material when the hardenable material is disposed adjacent the drain installation system.

* * * * *